United States Patent [19]

Cole

[11] Patent Number: 4,734,548

[45] Date of Patent: Mar. 29, 1988

[54] CAM OPERATED PROGRAM TIMER ASSEMBLY WITH HOUSING AND TERMINAL BLADE MOUNTING FEATURES

[75] Inventor: Ronald E. Cole, Greenwood, Ind.

[73] Assignee: Emhart Industries, Inc., Indianapolis, Ind.

[21] Appl. No.: 31,566

[22] Filed: Mar. 30, 1987

[51] Int. Cl.[4] ..... H01H 43/10; H01H 1/00; H01H 9/08

[52] U.S. Cl. ..... 200/38 R; 200/38 B; 200/283

[58] Field of Search ..... 200/19 A, 1 TK, 6 B, 200/6 BA, 6 BB, 6 C, 38 R, 38 B, 38 BA, 38 C, 38 CA, 38 D–38 DC, 283

[56] References Cited

U.S. PATENT DOCUMENTS

| | | | |
|---|---|---|---|
| 3,588,414 | 6/1971 | Prickett | 200/283 X |
| 3,727,015 | 4/1973 | Voland et al. | 200/38 R |
| 3,790,726 | 2/1974 | Brown | 200/38 B |
| 3,823,280 | 7/1974 | Obermann et al. | 200/38 B |
| 4,032,739 | 6/1977 | Nicolaisen et al. | 200/283 |
| 4,297,547 | 10/1981 | Chestnut | 200/38 R |

*Primary Examiner*—J. R. Scott
*Attorney, Agent, or Firm*—Carl A. Forest

[57] ABSTRACT

A timer having switches are responsive to a cam, the cam being driven through a timer motor through a clutch. The cam and the switches are disposed within a housing. The switches include electrical contact blades with cooperating electrical contacts. Electrical terminals are mounted in the housing and extend through the housing and are unitarily constructed with the switches to form a one piece combination. The electrical terminals are held within slots in a wall of the housing through a pair of projections lanced from the terminals which engage notches opening to the slots. The projections are individually in planes that are at an angle to each other such that their distal ends are directed away from each other and which are spring biased to act as cantilevered spring members and made to squeeze inwardly between sides of the notches. In the preferred configuration, the projections are pointed to act as barbs that dig into the comparatively soft plastic walls of the notch and tend to anchor the combination blade terminal in place.

3 Claims, 3 Drawing Figures

CAM OPERATED PROGRAM TIMER ASSEMBLY WITH HOUSING AND TERMINAL BLADE MOUNTING FEATURES

BACKGROUND OF THE INVENTION

Timers have long been used in appliances such as washers, dishwashers, dryers and refrigerators to control their functions. This is done by having electrical switches open and close in accordance with a program provided by a cam. The timers are usually motor driven through their own separate motor means, the motor means deriving its power from the power source of the refrigerator or components thereof.

In the manufacture of these timers, it is especially important that the electrical contact blades of the switches and/or the electrical terminals extending from the blades be securely held in place, usually by a wall of the timer housing. If they are not securely held, timing inaccuracies will occur. And in some cases, catastrophic failures could occur.

In U.S. Pat. No. 3,727,015, there is described and claimed a timer having combination electrical contact blades and electrical terminals individually held in a wall of the timer housing through a projection lanced from the electrical terminal and engaging a notch in the wall. And in U.S. Pat. Nos. 3,790,726 and 4,297,547 there is shown timers wherein the electrical blades are held by a pair of projections lanced from the blades and engaging slots.

SUMMARY OF THE INVENTION

The present invention relates to a timer having an improved structure for holding the electrical contact blades which in general comprises a timer having motor driven cam means and switch means responsive to the cam means both of which are disposed in a housing and wherein at least one electrical terminal extends into the housing and is electrically connected to the switch means, at least one slot in a wall of the housing receives the electrical terminal, a notch in the wall opens to the slot, and wherein there are at least two projections lanced from the electrical terminal, with the two projections individually being in planes that are at an angle to each other and the two projections being spring biased to act as cantilevered spring members and made to squeeze inwardly between sides of the notch.

DETAILED DESCRIPTION OF THE INVENTION

Figure 1:
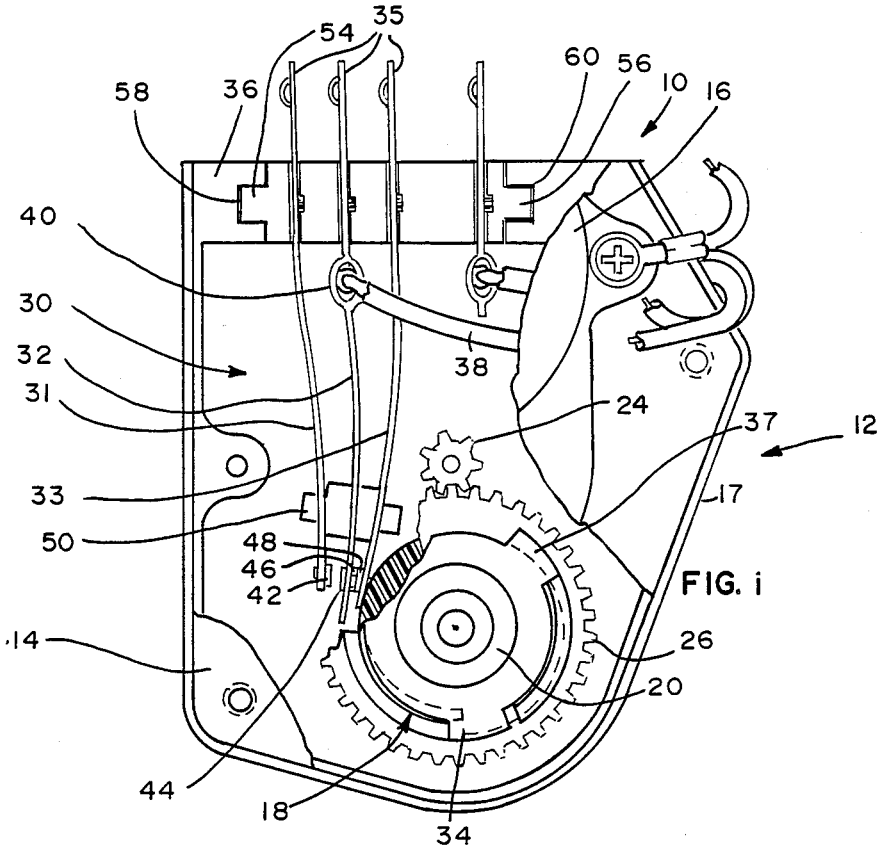
FIG. 1 is a view in partial cross-section of a timer employing the invention.

Referring now to the drawings, the various elements of a timer 10 are enclosed in a housing 12, the housing being formed from a cup-shaped member 17 which is closed by a cover plate 14 (partially shown). A constant speed motor 16 is connected to cover plate 14, the motor being used to drive a cam means 18. Cam means 18 includes a hub portion 20. Hub portion 20 is journalled in cover plate 14 and cup-shaped member 17 respectively. The motor drives cam means 18 through motor output pinion 24, a gear 26 unitarily constructed with the cam means, and a clutch (not shown). The clutch permits manual setting of the cam means in a manner well known in the timer art. Switch means 30 includes a plurality of switch blades 31, 32 and 33 that are responsive to cam means 18 through arcuate steps 34 formed on the cam means. Electrical terminals 35 are integrally constructed with the switch blades and are held in a wall 36 of the housing in a manner to be described. Electrical leads 38 are electrically connected to switch blades 32 through jacks 40.

In operation, motor 16 drives cam means 18 through motor output pinion 22, gear 26, and a clutch (not shown). As cam means 18 rotates switch, electrical contacts 42, 44, 46 and 48 are opened and closed through the bias of blades 31, 32 and 33 against arcuate steps 34 and 37 of the cam means. A spacer 50 helps maintain a proper spacing between the blades.

In a timer such as this where the blades are biased by the cam means at the tips of the blades, it is important that the blades be securely held to prevent their slippage and subsequent misalignment. In the present timer, this problem has been met by the structure particularly shown in FIGS. 2 and 3. As shown, a combination electrical contact blade 31 and electrical terminal 35 (as well as the other blades and/or electrical terminals) are held in a terminal block 52 which serves as part of wall 36 of timer housing 17. The terminal block is formed as part of the wall through tongues 54 and 56 engaging grooves 58 and 60 (FIG. 1) of the wall. The combination of blade and terminal is carried in a slot 62. There is a notch 64 opening to the slot, the notch having walls 66 and 68 that are transverse to the lengthwise direction to the combination blade and terminal. Both walls of the housing including the terminal block are made of a suitable plastic.

Figure 2:
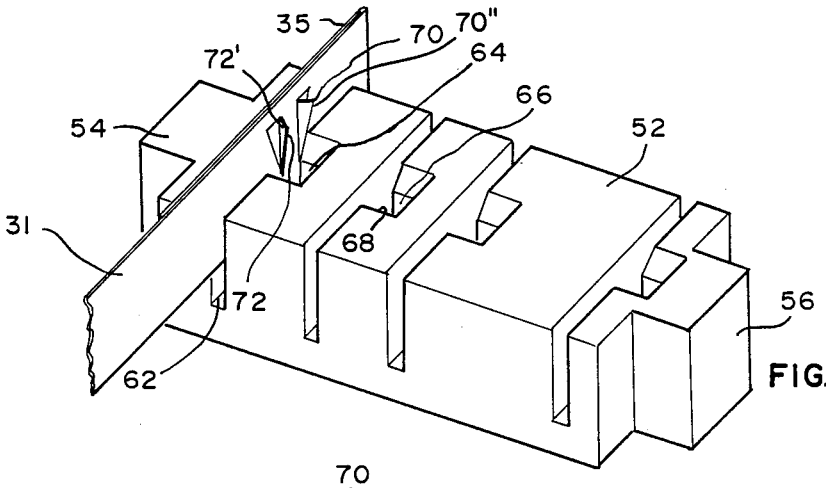
FIGS. 2 and 3 are views showing a terminal block carried in a wall of the timer housing showing how the electrical blades of the timer are held.
Figure 3:
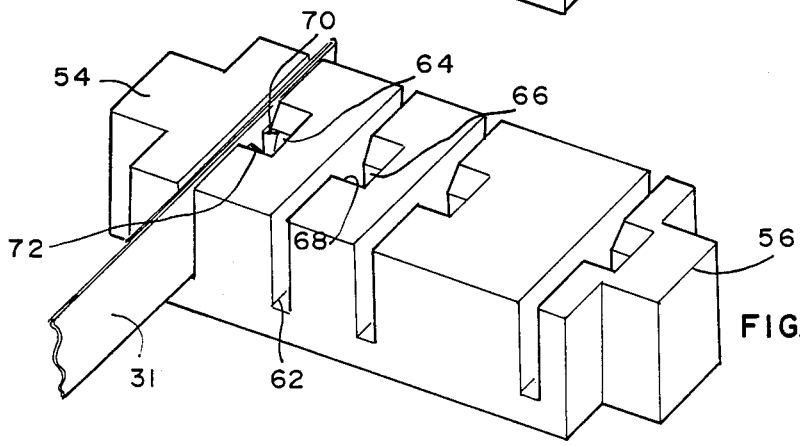

Each of the combination blade and terminal includes a pair of projections 70 and 72 lanced from the combination to act as cantilevered spring members or barbs. The projections are individually in planes that are at an angle to each other. They are lanced such their pointed distal ends 70'' and 72' are pointed away from each other with a strip of the combination between the two. FIG. 2 shows the blades just entering slot 62. As the combination is pressed into the slot, the projections are squeezed together and forced into notch 64. The fact that the projections are spring members with their pointed ends pointed away from each other greatly aid in the projection "digging into" the relatively soft plastic walls 66 and 68 of the notch.

Once the combination blades and terminals are in place cover 14 closes the slots 62.

What is claimed is:

1. In a timer having motor driven cam means and switch means responsive to said cam means both of which are disposed in a housing:

at least one combination electrical contact blade having a contact thereon and an electrical terminal extending into said housing and electrically connected to said switch means, at least one slot in a wall of said housing receiving said electrical terminal, a notch in said wall opening to said slot, and at least two projections lanced rom said electrical terminal, said two projections individually in planes that are at an angle to the other such that their distal ends are directed away from each other and spring biased to act as cantilevered spring members and made to squeeze inwardly and into walls of said notch.

2. In a timer according to claim 1 wherein said distal ends are pointed.

3. In a timer according to claim 2 wherein said projections are lanced such that there is a strip of terminal between each projection.

* * * * *